United States Patent [19]

Mizuguchi

[11] Patent Number: 4,903,563

[45] Date of Patent: Feb. 27, 1990

[54] SOUND BAR ELECTRONIC MUSICAL INSTRUMENT

[75] Inventor: Masaaki Mizuguchi, Hamamatsu, Japan

[73] Assignee: Nippon Gakki Seizo Kabushiki Kaisha, Japan

[21] Appl. No.: 376,891

[22] Filed: Jul. 5, 1989

Related U.S. Application Data

[63] Continuation of Ser. No. 65,585, Jun. 23, 1987, abandoned.

[30] Foreign Application Priority Data

| | | | |
|---|---|---|---|
| Jun. 25, 1986 | [JP] | Japan | 61-149917 |
| Sep. 5, 1986 | [JP] | Japan | 61-209261 |
| Sep. 5, 1986 | [JP] | Japan | 61-209262 |
| Sep. 5, 1986 | [JP] | Japan | 61-209263 |

[51] Int. Cl.[4] ..... G10H 3/20

[52] U.S. Cl. ..... 84/723; 84/DIG. 7; 84/DIG. 24

[58] Field of Search ..... 84/1.04, 1.06, 1.14, 84/1.15, 1.1, 1.28, DIG. 7, DIG. 24; 200/5 A, 86 R; 341/20, 22, 26, 27, 34

[56] References Cited

U.S. PATENT DOCUMENTS

| | | | |
|---|---|---|---|
| 1,849,271 | 3/1932 | Bower | 84/DIG. 24 X |
| 2,959,693 | 11/1960 | Meyer | 84/1.14 X |
| 3,542,936 | 11/1970 | Babicky | 84/1.06 |
| 3,644,656 | 2/1972 | Fender et al. | 84/1.06 X |
| 3,649,737 | 3/1972 | Jespersen | 84/1.04 X |
| 3,684,814 | 8/1972 | Neustadt | 84/1.04 |
| 3,699,294 | 10/1972 | Sudduth | 200/86 R X |
| 4,137,810 | 2/1979 | Wheelwright et al. | 84/1.03 |
| 4,522,099 | 6/1985 | Melsheimer | 84/1.28 X |

*Primary Examiner*—Stanley J. Witkowski

*Attorney, Agent, or Firm*—Ostrolenk, Faber, Gerb & Soffen

[57] ABSTRACT

In the construction of a sound bar musical instrument such as a marimba, at least some of the sound bars have sensors attached thereto. The sensors are electrically connected to an electronic sound generator unit for generation of musical tones as a function of the vibration of battered sound bars, thereby allowing free use of a mallet and enabling visual contact of the performer with the audience.

10 Claims, 13 Drawing Sheets

SOUND BAR ELECTRONIC MUSICAL INSTRUMENT

This is a continuation of Application Ser. No. 07/065,585, filed on June 23, 1987 and now abandoned.

BACKGROUND OF THE INVENTION

The present invention relates to an improved sound bar musical instrument, and more particularly relates to improvement in construction of an electronic sound bar musical instrument which generates, in addition to ordinary tones, electronically formed tones.

When playing a sound bar musical instrument such as a xylophone or a marimba, a performer has to operate not only its sound bars but also electronic drum and/or control switches for sound effectors. In order to carry out such a combined performance, the electronic drum and, for example, a marimba are arranged close to each other and the performer stands on one side of the marimba. The performer then batters sound bars of the marimba with a mallet and, concurrently, batters panels of the electronic drum which is arranged on the other side of the marimba extending over the sound bars of the marimba.

In order to enable the single performer to operate the marimba and the electronic drum at the same time, the panels of the marimba have to be arranged within the ambit of the mallet operated by the performer. For this reason the panels of the electronic drum are conventionally arranged above the sound bars of the marimba. With such an arrangement, the performer can swiftly batter the panels during performance of the marimba. When the mallet is swung wide for rhythm adjustment, however, the mallet is likely to hit the panels unexpectedly and this greatly limits free action of the performer. Further, when panels of relatively large batter heads are arranged above the marimba, visual contact of the performer with the audience is greatly reduced and, as a consequence, the performer cannot catch the sentimental reaction of the audience.

SUMMARY OF THE INVENTION

It is the object of the present invention to remove restrictions on the action of the performer and on the visual contact of the performer with the audience during performance of an electronic sound bar musical instrument.

In accordance with the basic aspect of the present invention, a group of sound bars are juxtaposed in sequence on a frame for generation of musical tones, at least one member is arranged on the frame in the vicinity of the sound bars, and a sensor is coupled to the at least one member for generation of electric signals in response to vibration of the at least one member when the latter is battered.

DESCRIPTION OF THE PREFERRED EMBODIMENTS

In accordance with the first subordinate aspect of the present invention, the sound bar musical instrument comprises first to third groups of sound bars arranged on the frame, the first group of sound bars generate musical notes in a prescribed scale, the second group of sound bars generate sharps and flats in the prescribed scale (large spaces are provided between some adjacent second sound bars of the second group and the first and second groups of sound bars are arranged in two horizontal and parallel tiers) and the third group of sound bars (a single sound bar can define the group) are arranged in the large spaces between adjacent sound bars of the second group.

Figure 1:
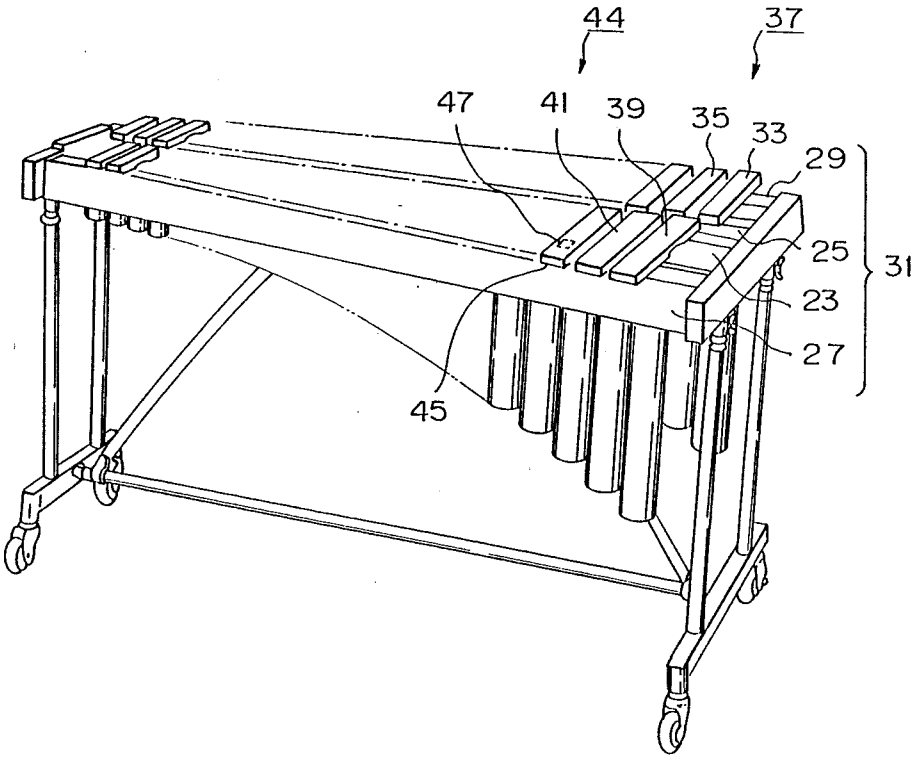
FIG. 1 is a perspective view of one embodiment of the sound bar musical instrument in accordance with the present invention.
Figure 2:
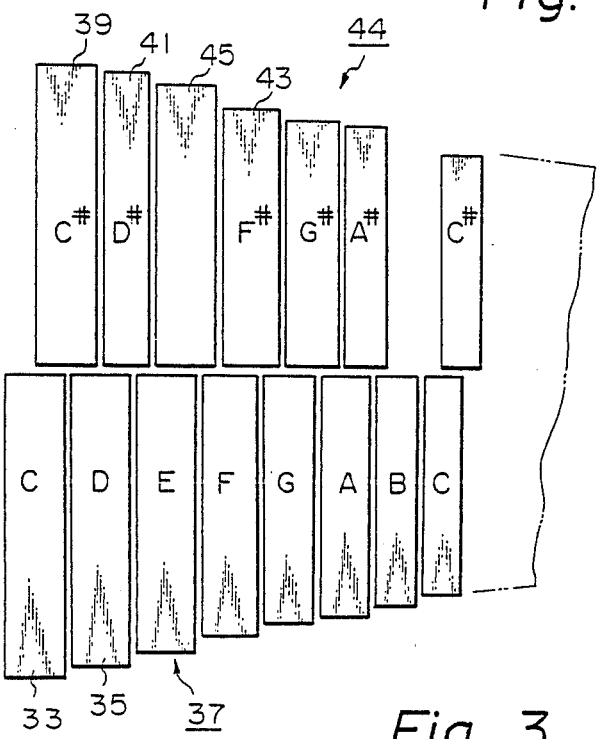
FIG. 2 is a plan view of sound bars on the sound bar musical instrument shown in FIG. 1.

One embodiment of the sound bar musical instrument in accordance with the first subordinate aspect of the present invention is shown in FIGS. 1 to 4, in which the present invention is applied to a marimba. As best seen in FIG. 1, the marimba includes a frame 31. The frame 31 includes a pair of parallel center beams 23 and 25 extending horizontally and a pair of outer beams 27 and 29 arranged on opposite sides of the center beams 23 and 25 while extending horizontally. The spaces between the center beams 23, 25 and the outer beams 27, 29 diminish in the longitudinal direction thereof. The first group of sound bars 37 (including sound bars 33, 35, . . . ) are juxtaposed in sequence on the center and outer beams 25 and 29. These sound bars generate musical notes in a prescribed scale as shown in FIG. 2. The second group of sound bars 44 (including sound bars 39, 41, 43 . . . ) are juxtaposed in sequence on the center and outer beams 23 and 27. These second sound bars generate sharps and flats in the prescribed scale. Some adjacent sound bars of the sound group 44 have. The second sound large spaces therebetween. For example in FIG. 2, there is a large space between the sound bar 41 for the note D# and the sound bar 43 for the note F#.

The sound bars (the single sound bar 45 of FIG. 2) of the third group are located in large spaces between adjacent sound bars of the second group 44.

Figure 3:
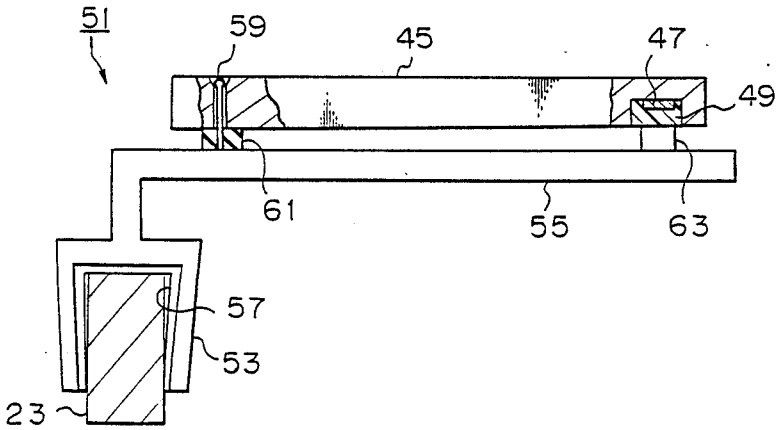
FIG. 3 is a side view, partly in section, of one example of the second sound bar used for the musical instrument shown in FIG. 1.

As shown in FIG. 3, each sound bar 45 of the third group is accompanied with a sensor 47, e.g. a piezoelectric element, fixed in a recess formed in its bottom surface by means of a resin plug 49. The sound bar 45 is held by a bracket 41 detachably coupled to the center beam 23. The bracket 51 includes an angled clamping section 53 and a horizontal holding section 55 for holding the sound bar 45. The clamping section 53 is internally provided with a shock absorber 57 such as a felt sheet and forcedly inserted over the center beam 23 for elastic clamping to the center beam 23. The presence of the shock absorber 57 effectively blocks transmission of vibration of the sound bar 45 to the frame 31 via the bracket 51. A pin 59 is secured to the top surface of the proximal end of the holding section 55 of the bracket 51 and is embraced by a shock absorber 61 such as a felt sheet. This pin 59 is inserted into a corresponding hole in the sound bar 45. An additional shock absorber 63 is also provided on the top surface of the holding section 55 in contact with the sound bar 45. The shock absorbers 61 and 63 cooperate to absorb vibration of the sound bar 45 when the latter is battered.

Since the bracket 51 is detachable from the center beam 23, as illustrated in FIG. 3, the performer can place the sound bars 45 at any location suited for performance. The import of this feature is that, unlike conventional bars which are designed for being mounted at a fixed location, the sound bar 45 of the present invention can be "repositioned". That is, the performer is provided with the option to place any of the sound bars 45 at any available, desired location on the beam 23.

Figure 4:
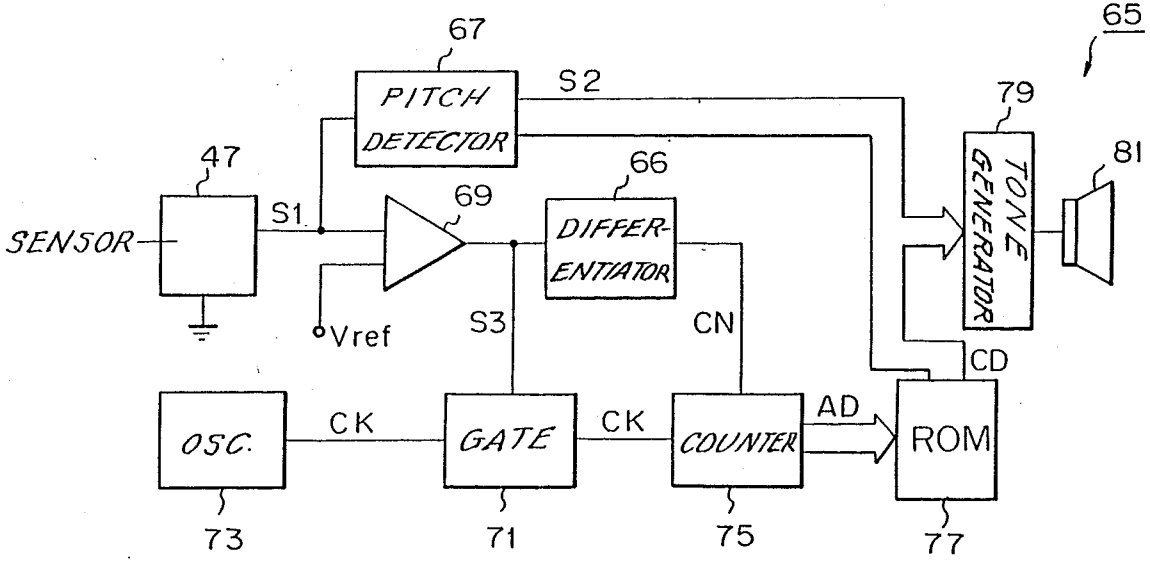
FIG. 4 is a circuit diagram of a sound generator unit used for the musical instrument shown in FIG. 1.

All of the sensors 47 are connected to an electronic sound generator unit 65 shown in FIG. 4 and supply an electric signal S1 having a wave shape patterned after the vibration appearing on the associated sound bar 45.

The electronic sound generator unit 65 includes a pitch detecting circuit 67 connected to the sensors 47, a comparator 69 connected to the sensors 47 and a supply source of a reference voltage Vref and differentiation circuit 66 connected to the comparator 69. The sound generator unit 65 further includes an oscillator 73 generating a clock pulse CK, a gate circuit 71 connected to the comparator 69 and the oscillator 73, and a counter 75 connected to the differentiation circuit 66 and the gate circuit 71. This counter 75 is connected on its output side to a read only memory 77. The sound generator unit 65 further includes a musical tone generating circuit 79 connected on the input side to the pitch detecting circuit 67 and the read only memory 77, and further connected on the output side to a sound system 81.

One of the sensors 47 supplies its electric signal S1 to the pitch detecting circuit 67 which, after detection of the pitch of the vibration appearing on the associated sound bar 45, issues on electric signal S2 representative of the detected pitch. The electric signal S1 from the sensor 47 is also passed to the comparator 69. On comparison of the electric signal S1 with the reference voltage Vref, the comparator 69 issues a gate-on signal S3 which is at a high level as long as the voltage of the electric signal S1 exceeds the reference voltage Vref. This gate-on signal S3 is supplied to the gate circuit 71. Whenever it receives of the gate-on signal S3, the gate circuit 71 allows passage of the clock pulse CK from the oscillator 73 to the counter 75. The gate-on signal S3 is also supplied to the differentiation circuit 66 for generation of a control signal CN which is passed to the counter 75. The counter 75 counts the clock pulses CK from the gate circuit 71 and, in synchronism with receipt of the control signal CN from the differentiation circuit 66, issues an address signal AD representative of its count value which is passed to the read only memory 77. The high level period of the gate-on signal S3 is proportional to the dynamic range and the envelope of the vibration appearing on the sound bar battered. So, when information on the dynamic range and the envelope of the vibration is stored in the address of the read only memory 77 corresponding to the count value of the counter 75, the musical tone generating circuit 79 is able to issue a musical tone signal depending on the electric signal S2 and a code signal CD representing such information. Such a musical tone signal has prescribed pitch, dynamic range and envelope and is passed to the sound system 81 for generation of a musical tone.

Figure 5:
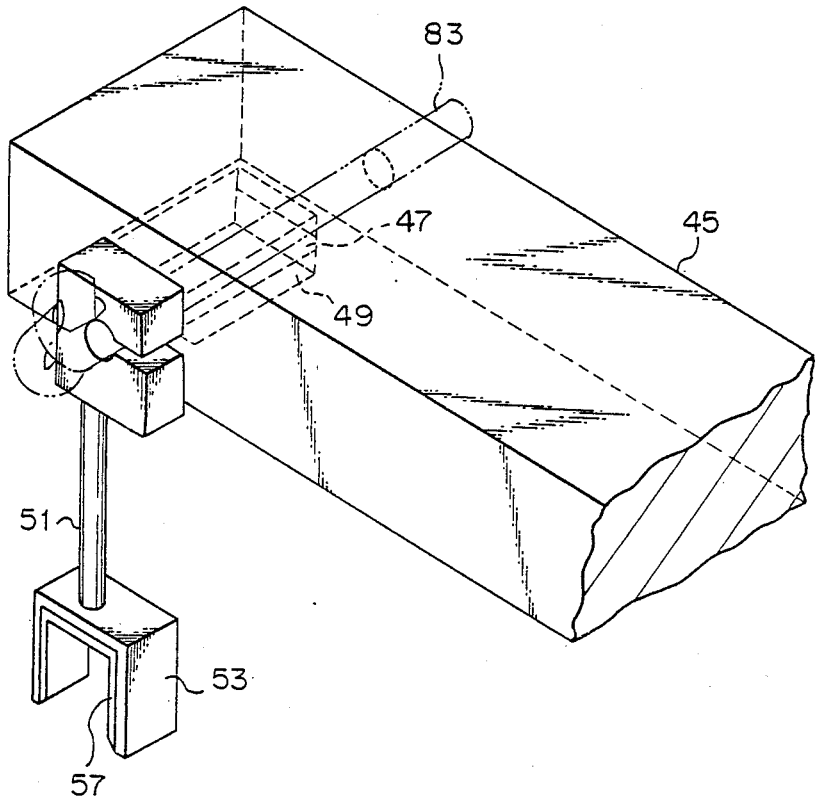
FIG. 5 is a perspective view of another example of the second sound bar used for the musical instrument shown in FIG. 1.

Another embodiment of the sound bar musical instrument in accordance with the first subordinate aspect of the present invention is shown in FIG. 5, in which the sound bar 45 of the third group is accompanied with a string 83 and a bracket 51 coupling the string 83 to the frame 31 as in the case of the first and second sound bars for generation of musical tones. A transverse bore is formed in each end of the sound bar 45 for passage of the string 83 which passes through the top end of the bracket 51. The string 83 is provided at its both ends with knots for stable combination of the sound bar 45 with the bracket 51. Like the foregoing embodiment, a sensor 47 is fixed in the bottom recess by a resin plug 49. In this case, the bracket 51 is detachably mounted to the center beam 23. As a substitute, however, the bracket 51 may be fixed to the center beam 23 and the string 83 may be constructed detachable from the bracket 51.

Figure 6:
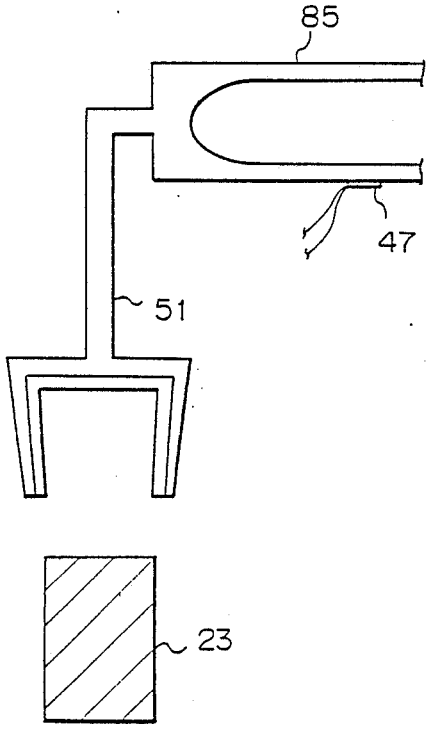
FIG. 6 is a side view of the other example of the second sound bar used for the musical instrument shown in FIG. 1.

The other embodiment of the sound bar musical instrument in accordance with the first subordinate aspect of the present invention is shown in FIG. 6, in which the third sound bar takes the form of a tuning fork 85 coupled in one body to the detachable bracket 51.

In the case of the sound generator unit 65 shown in FIG. 4, the pitch detecting circuit 67 issued the electric signal S2 representative of the pitch of the vibration appearing on the sound bar 45 battered for ultimate formation of the musical tone signal. The gate-on signal S3 from the comparator 69 may be used for generation of bell and/or chime tones. Output from the comparator 69 may further be used for triggering operations of a tape recorder, a synthesizer or a rhythm sound generator unit for reproduction and/or synthesization of stored melodies and rythms.

In accordance with the second subordinate aspect of the present invention, sound bars of the third group are displaceably mounted to the frame.

Figure 7:
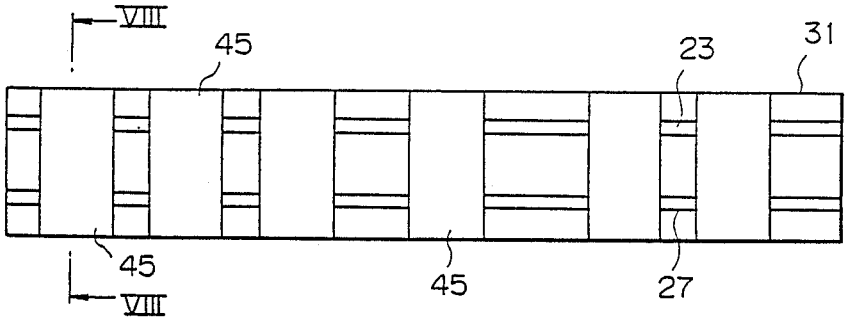
FIG. 7 is a plan view of another embodiment of the sound bar musical instrument in accordance with the present invention.
Figure 8:
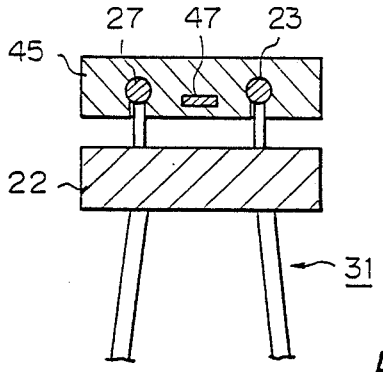
FIG. 8 is a section taken along a line VIII—VIII in FIG. 7.
Figure 9:
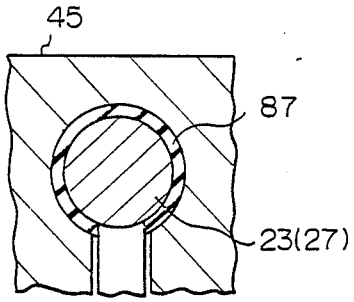
FIG. 9 is a sectional view for showing mounting of the second sound bar to a center beam on the musical instrument shown in FIG. 7.

One embodiment of the sound bar musical instrument in accordance with the second subordinate aspect of the present invention is shown in FIGS. 7 to 9.

The third group sound bars 45 are displaceably arranged side by side on the horizontal beams or rails 23 and 27 of the frame 31 at specified, different intervals as shown in FIG. 7. As best seen in FIG. 8, each sound bar 45 is provided with a sensor 47, such as a piezoelectric element, fully embedded in its body and the beams 23 and 27 of the frame 31 are also received in the body. The beams 23 and 27 are fully embraced by a shock absorber 87, such as a felt sheet as shown in FIG. 9, in order to block transmission of vibration appearing on the sound bar 45 battered to the frame 31. The sensors 47 are connected to a sound generator unit such as shown in FIG. 4.

Figure 10:
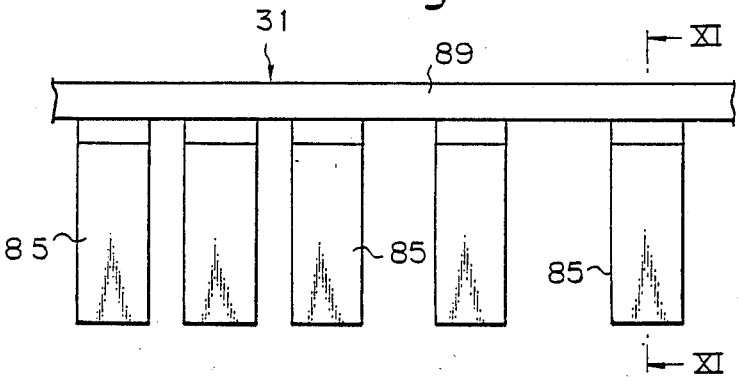
FIG. 10 is a plan view of the other embodiment of the sound bar musical instrument in accordance with the present invention.
Figure 11:
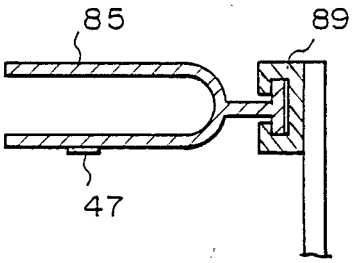
FIG. 11 is a section taken along a line XI—XI in FIG. 10.
Figure 12:
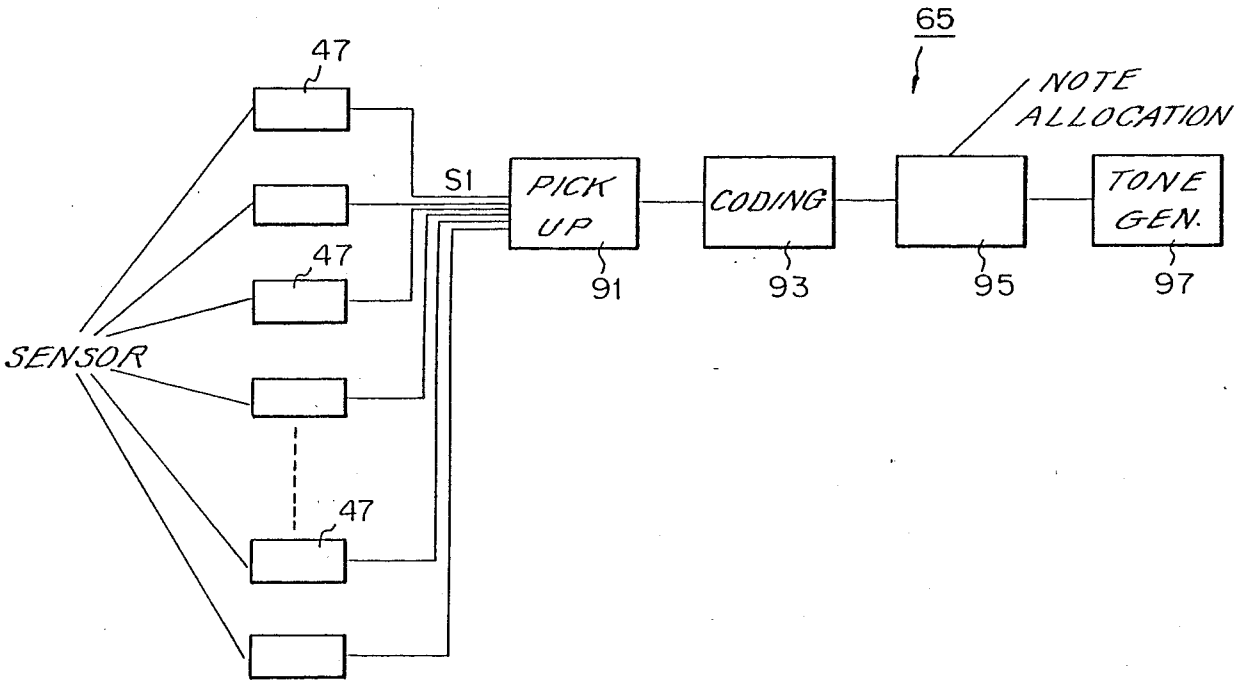
FIG. 12 is a circuit diagram of one example of the sound generator unit used for the musical instrument shown in FIG. 10.

The other embodiment of the sound bar musical instrument in accordance with the second subordinate aspect of the present invention is shown in FIGS. 10 to 12 in which the sound bars of the third group take the form of tuning forks 85. More specifically, as shown in FIG. 11, each tuning fork 85 is horizontally held at its proximal end by a guide rail 89 of the frame 31 in a displaceable fashion.

The sensors 47 are connected to a sound generator unit 65 shown in FIG. 12. In this case, the sound generator unit 65 includes a pick-up circuit 91, a coding circuit 93, a note allocation circuit 95 and a musical tone generation circuit 97 connected in series in the described order. An electric signal S1 from each sensor 47 is first passed to the pick-up circuit 91 which issues an electric signal representative of the strength and duration of the battering on the associated tuning fork 85. This electric signal is then coded at the coding circuit 93 for supply to the note allocation circuit 95. The note allocation circuit 95 allocates different notes to different tuning forks 85. On receipt of the coded signal, the note allocation circuit 95 issues an electric signal representative of the code corresponding to the tuning fork 85 battered for supply to the musical tone generating circuit 97 which is substantially same in function as the musical tone generating circuit 79 shown in FIG. 4.

Figure 13:
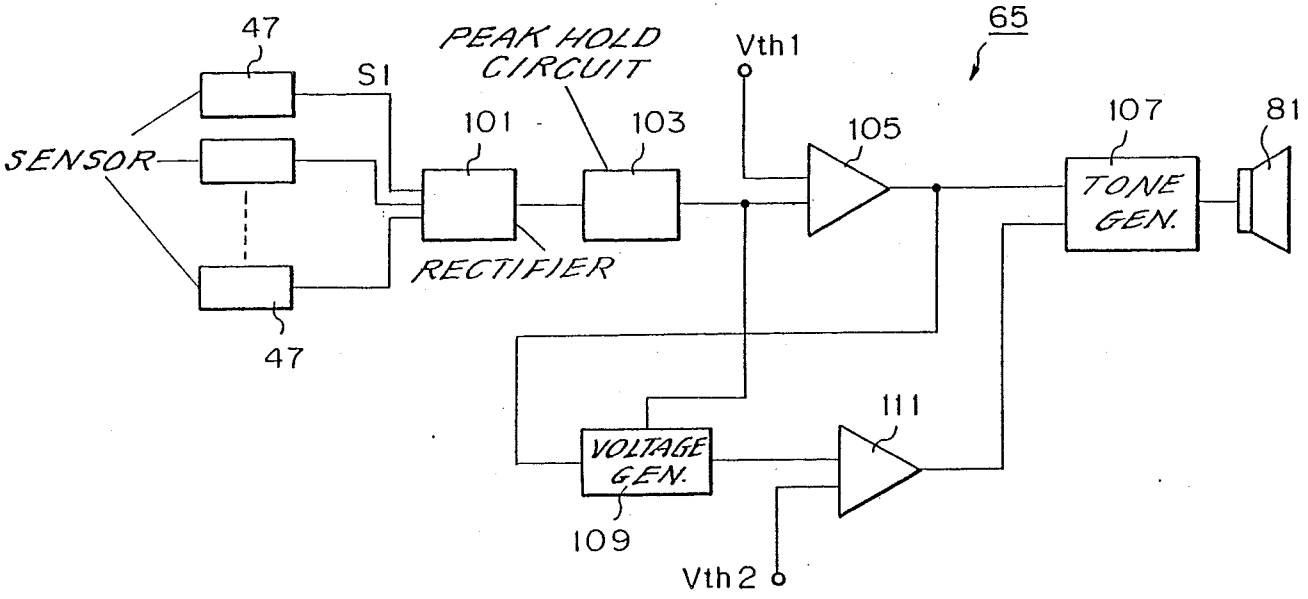
FIG. 13 is a circuit diagram of the other example of the sound generator unit used for the musical instrument in accordance with the present invention.
Figure 14:
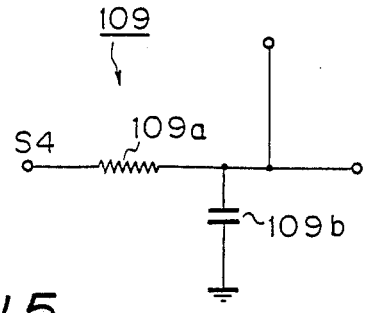
FIG. 14 is a circuit diagram of one example of the lamp voltage generating circuit used for the sound generator unit shown in FIG. 13.

The other embodiment of the sound generator unit 65 used for the sound bar musical instrument in accordance with the present invention is shown in FIGS. 13 and 14, in which the sound, generator unit 65 includes continual tone generation time indicating means and tone volume indicating means interposed between the sensors 47 and the musical tone generating circuit 79.

More specifically in FIG. 13, the sensors 47 attached to the sound bars 45 of the third group are connected to a rectifier circuit 101 which is in turn connected to the input terminal of a peak hold circuit 103. The peak hold circuit 103 is connected on one hand to one input terminal of the first comparator 105. The other input terminal of the comparator 105 is connected to a supply source of the first threshold value Vth1. The peak hold circuit 103 and the first comparator 105 form the continual tone generation time indicating means. The first comparator 105 is one hand connected to one input terminal of the musical tone generating circuit 107 which is substantially same in function as the musical tone generating circuit 70 shown in FIG. 4.

The peak hold circuit 103 is one the other hand connected to one input terminal of a lamp voltage generating circuit 109 whereas the first comparator 105 is also on the other hand connected to the other input terminal of the voltage generating circuit 109. The voltage generating circuit 109 is in turn connected to one input terminal of the second comparator 111. The other input terminal of the second comparator 111 is connected to a supply source of the second threshold value Vth2. The lamp voltage generating circuit 109 and the second comparator 111 form the tone volume indicating means. The second comparator 111 is connected to the other input terminal of the musical tone generating circuit 107 which is in turn connected to the sound system 81.

One example of the lamp voltage generating circuit 109 is given in the form of an RC circuit which is shown in FIG. 14 and has a time constant CR. The RC circuit includes a resistor **109*a* and a capacitor 109*b*** connected in series.

Figure 15:
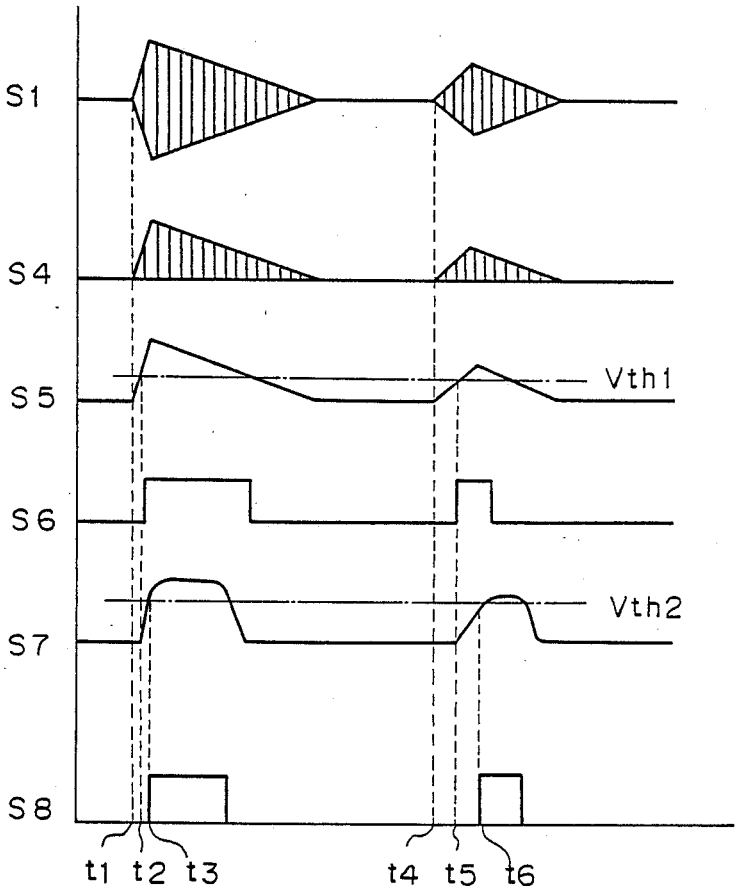
FIG. 15 is a graph of various signals processed in the sound generator unit shown in FIG. 13.

The electric signal S1 issued by the sensor 47 coupled to the sound bar 45 battered at a moment t1 is passed to the rectifier circuit 101. After half wave rectification as shown in FIG. 15, a half wave signal S4 including the positive voltage sections of the signal S1 is passed to the peak hold circuit 103 which in turn issues an envelope signal S5 for supply to the first comparator 103. Only when the voltage of the envelope signal S5 exceeds the first threshold value Vth1, the first comparator 105 supplies a continual tone generation signal S6 to the musical tone generating circuit 107. Issuance of this signal 56 is initiated at a moment t1. Then the musical tone generating circuit 107 issues a musical tone signal allotted to the third sound bar battered for supply to the sound system 81.

The continual tone generation signal S6 is passed to the lamp voltage generating circuit 109 too for formation of a tone volume indicative signal S8. That is, an output signal having a indexically diminishing rising speed is formed and overlapped with the envelope signal S5 from the peak hold circuit 103 to form an ultimate output signal S7 having a rising speed corresponding to the wave height of the electric signal S1. This output signal S7 is then passed to the second comparator 111 for comparison with the second threshold value Vth2. When the voltage of the output signal S7 exceeds the second threshold value Vth2 at a moment t3, the second comparator 111 issue the tone volume indicative signal S8 for supply to the musical tone generating circuit 107. As a consequence, the musical tone generating circuit 107 determines the duration of tone generation on the basis of the continual tone generation signal S6, and further determines the volume of the tone to be generated on the basis of the tone volume indicative signal S8.

When, for example, the sound bar 45 is strongly battered and an electric signal S1 of a high wave height is issued by an associated sensor 47 at the moment t1, a continual tone generation signal S6 is issued at the moment t2 and a tone volume indicative signal S8 is issued at the moment t3. As a result, the interval between the moments t2 and t3 becomes relatively short and the tone volume becomes relatively large.

Conversely, when the sound bar 45 is lightly battered and an electric signal S1 of a low wave height is issued by an associated sensor 47 at a moment t4, a continual tone generation signal S6 is issued at a moment t5 and a tone volume indicative signal S8 is issued at a moment t6. In this case, since the output signal S7 from the volume generating circuit 109 rises slowly, the time before the output signal S7 exceeds the second threshold value Vth2, the interval between the moments t5 and t6 becomes long and the musical tone generating circuit 107 is able to know early the volume of the tone to be generated.

In the case of the foregoing embodiment, the sound bar musical instrument is provided with a number of sound bars of the third group which are generative of different vibrations when battered. An equal number of sensors are attached to respective sound bars of the third group for conversion of the vibrations into corresponding electric signals. A sound generator unit is connected to the sensors for processing of the electric signals and generation of ultimate musical tones.

In the case of an electronic sound bar musical instrument provided with sound bars for generation of usual musical notes only, a mallet is used in various ways during performance and the sound bars are able to generate a wide variety of musical tones depending on the manner in which the mallet is used.

In order to obtain a certain musical effect on an electronic sound bar musical instrument, it is necessary to measure the length of time during which a mallet is in pressure contact with each sound bar and to discriminate the manner of use of the mallet depending on the result of such measurement. In one example of such a system, each sound bar is accompanied with a hollow casing made of an insulating material. A switch plate made of conductive material is fixed at one end to the casing whilst the other end projecting into the center cavity of the casing. Three sets of contacts are mounted to the casing whilst being exposed into the center cavity. When no external force is applied, the switch plate is held in contact with the first and second contacts thereby electrically connecting the first and second. When the associated sound bar is battered by a mallet, external force is applied to the switch plate momentarily gets out of contact with the second contact, comes into contact with the third contact in order to electrically connect the first and third contact and returns to the initial position in order to again electrically connect the first and second contacts. When the sound bar is battered short by the mallet, a short time is required for the switch plate to return to the initial position. Whereas, when the sound bar is battered long by the mallet, a long time is required for the switch plate to return to the initial position. Thus, by measuring the time necessary for return of the switch plate, the manner of use of the mallet can be discriminated for control of generation time of a corresponding musical tone.

When such a system is employed on an electronic sound bar musical instrument, a sound bar is liable to be battered at different points and, as a consequence, the point of external force application varies greatly. Such variation in point of external force application tends to cause accidental breakage of the casing and the mobile part, i.e. the switch plate.

Figure 16:
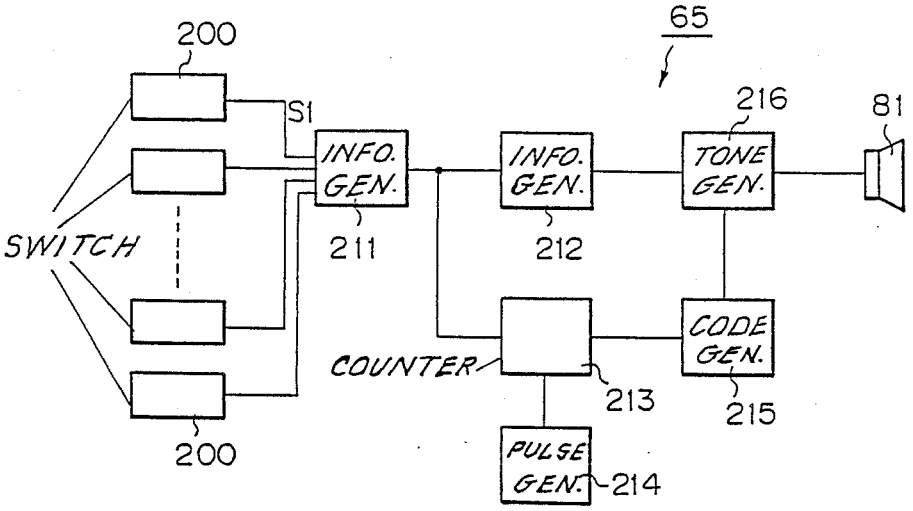
FIG. 16 is a circuit diagram of the other example of the sound generator unit used for the sound bar musical instrument in accordance with the present invention.
Figure 17:
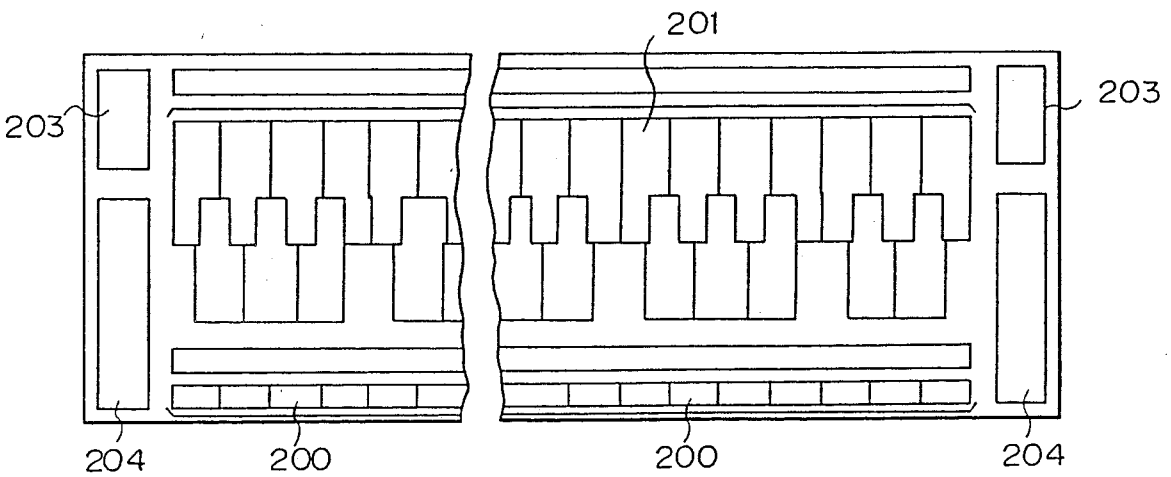
FIG. 17 is a plan view of the other embodiment of the musical instrument in accordance with the present invention.

In the case of the following embodiments of the sound bar musical instrument in accordance with the present invention, discrimination of the manner of use of the mallet is carried out in a purely electric way. One example of the keyboard is shown in FIG. 17, in which a number of response switches 200, which correspond in function to the third sound bars 45 used in the foregoing embodiments, are juxtaposed and accompanied with tone color selection switches 201, speakers 203 and control sections 204. As in the foregoing embodiments, the response switches 200 are connected to a common sound generator unit 65 shown in FIG. 16.

In the case of this embodiment, the tone generator unit 65 includes a sound bar information generating circuit 211 which is connected to a musical tone generating circuit 216 via a note information generating circuit 212. The sound bar information generating circuit 211 is also connected on the output side to a counter 213 accompanied with a clock pulse generator 214. The counter 213 is connected on the output side to the musical tone generating circuit 216 via a code generating circuit 215. The musical tone generating circuit 216 is connected on the output side to a sound system 81.

Figure 18:
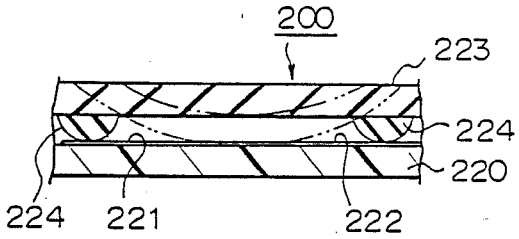
FIGS. 18 and 19 are side sectional and plan views of a response switch used for the musical instrument shown in FIG. 17.
Figure 19:
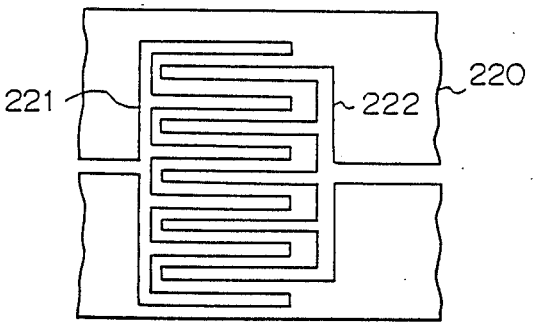

The construction of each response switch 200 is shown in detail in FIGS. 18 and 19. Each response switch 200 includes a substrate 220 made of synthetic resin and a pair of conductive patterns 221 and 222 printed on the substrate 220 without any contact to each other. A flat sounder 223 made of conductive rubber is placed on the substrate 22 via insulating rubber bars 224. The sounder 223 is usually kept spaced from the substrate as shown with solid lines in FIG. 18. When battered by a mallet, the sounder 223 flexes downwards as shown with chain lines and comes into contact with the conductive patterns 221 and 222 on the substrate 220. One of the conductive patterns is connected to a power source and the other to one input terminal of the sound bar information generating circuit 211 shown in FIG. 16.

Figure 20:
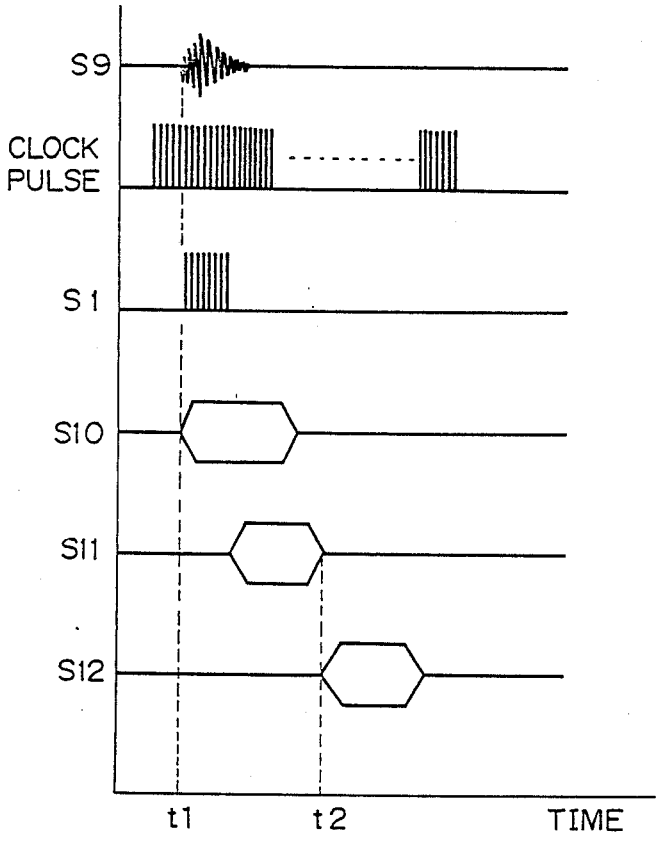
FIG. 20 is a graph of various signals processed in the sound generator unit shown in FIG. 16.

When one response switch 200 is battered by a mallet, the conductive patterns 221 and 222 are connected by the flexing sounder 223 to issue an electric signal S1 at a moment t1 in FIG. 20. On receipt of this electric signal S1, the sound bar information generating circuit 211 discriminates the battered response switch and issues a sound bar indicative signal S9 for supply to the note information generating circuit 212 which in turn generates a note code signal S10 for supply to the musical tone generating circuit 216. The sound bar indicative signal S9 is also passed to the counter 213 which counts clock pulses from the clock pulse generator 214 as supply of the sound bar indicative signal S9 continues. Thus, the counter 213 and the clock pulse generator 214 forms means for measuring the time of battering. At a moment t1 supply of the sound bar indicative signal S9 ceases and the counter 213 issues its count value signal S11 for supply to the code generating circuit 215. This code generating circuit 215 issues a control signal S12 which assumes a small value for a large count value signal S11, and a large value for a small count value signal S12.

Figure 21:
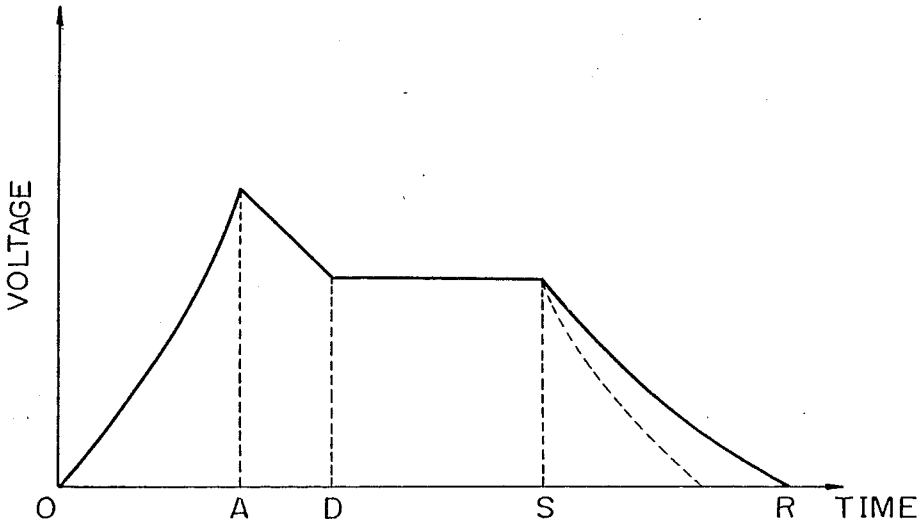
FIG. 21 is a graph of the tone volume envelope formed by the sound generator unit shown in FIG. 16.

On receipt of the note code signal S10 from the note information generating circuit 212, the musical tone generating circuit 216 fixes the attack time A, the decay time D and the sustain time S of a tone volume envelope shown in FIG. 21. Further, on receipt of the control signal S12 from the code generating circuit 215, the musical tone generating circuit 216 fixes the release time R of the tone volume envelope shown in FIG. 21.

As a consequence, when a response switch 200 is battered short by a mallet, the conductive patterns 221 and 222 are electrically connected for a short time, the sound bar indicative signal S9 lasts short and the count value signal S11 becomes small. Then, the code generating circuit 215 issues a large control signal S12 and a long release time R is resulted as shown with a solid line in FIG. 21. As a result, generation of the musical tone lasts long as if a natural marimba is played in a same manner.

When the response switch 200 is battered long by the mallet, the conductive patterns 221 and 222 are electrically connected for a long time, the sound bar indicative signal S9 lasts long and the count value signal S11 becomes large. Then, the code generating circuit 215 issues a small control signal S12 and a short release time R′ is resulted as shown with a dot line in FIG. 21. As a result, generation of the musical tone lasts short as if a natural marimba is played in a same manner.

I claim:

1. An improved sound bar electronic musical instrument comprising:

a frame;

a group of sound bars located side by side on said frame for generation of musical tones, an imaginary straight line passing through all of said sound bars;

a member;

means for coupling said member to said frame in the vicinity of said sound bars in a manner permitting said member to be repositioned by a performer at a desired location, substantially along said imaginary line;

a sensor coupled to said member for generation of electric signals in response to vibration of said member when said member is battered; and a sound generator unit electrically connected to said sensor and processing said electric signals for generation of a musical tone corresponding to vibration of said battered member.

2. An improved sound bar musical instrument as claimed in claim 1 in which said member is located between two adjacent said bars.

3. An improved sound bar musical instrument as claimed in claim 1 in which said sound generator unit includes:

a comparator whose inputs are connected to said sensor and a reference voltage, respectively; a pitch detecting circuit whose input is connected to said sensor; an oscillator; a gate circuit whose inputs are connected to an output of said comparator and said oscillator, respectively; a counter whose inputs are connected to an output of said comparator and an output of said gate circuit, respectively; a read only memory connected to an output of said counter; and a musical tone generating circuit whose inputs are connected to said pitch detecting circuit and said read only memory, respectively.

4. An improved sound bar musical instrument is claimed in claim 1 in which said member is a tuning fork.

5. An improved sound bar musical instrument as claimed in claim 1 in which said sound generator unit includes: a pick up circuit whose input is connected to said sensor; a coding circuit connected to said pick up circuit; a note allocation circuit connected to said coding circuit; and a musical tone generating circuit connected to said note allocation circuit.

6. An improved sound bar musical instrument as claimed in claim 1 in which said sound generator unit includes: a rectifier circuit whose input is connected to said sensor; a peak hold circuit connected to said rectifier circuit; a first comparator whose inputs are connected to said peak hold circuit and a first threshold voltage, respectively; a lamp voltage generating circuit whose inputs are connected to said peak hold circuit and said first comparator, respectively; a second comparator whose inputs are connected to said lamp voltage generating circuit and a second threshold voltage, respectively; and a musical tone generating circuit whose inputs are connected to said first and second comparators, respectively.

7. An improved sound bar musical instrument as claimed in claim 1 in which said sound generator unit includes:

a sound bar information generating circuit; a note information generating circuit; a counter whose inputs are connected to both said sound bar information generating circuit and a clock pulse generator; a code generating circuit connected to said counter; and a musical tone generating circuit connected to said note information generating circuit and said code generating circuit.

8. An improved sound bar musical instrument as claimed in claim 1 in which said member is a response switch which includes:

an insulating substrate; a pair of separate conductive patterns printed on said substrate, one of said conductive patterns being connected to a powder source, the other of said conductive patterns being connected to said sound generating unit; a flexible sounder spaced above said substrate in an arrangement such that it flexes towards said substrate and concurrently contacts said conductive patterns when it is battered.

9. An improved sound bar electronic musical instrument according to claim 1, wherein said coupling means couples said member to said frame via a frictional coupling.

10. A musical instrument arrangement, comprising:

a first group of sound bars located side-by-side in a common plane; a first imaginary line extending through all of said sound bars of said first group;

a second group of sound bars located side by side in said plane; a second imaginary line extending through all of said sound bars of said second group; said second imaginary line extending parallel to but spaced from said first imaginary line such that said first and second groups of sound bars are spaced from each other in a direction perpendicular to said imaginary lines;

a member arranged in said plane in a space between two adjacent sound bars of said second group;

said sound bars of said first and second groups generating musical tones when struck and said sound bars of said first and second groups not being connected to electronic sound reproducing equipment; and electronic means coupled to said member for generating an electrically generated acoustical sound in response to vibrations of said member when said member is struck.

* * * * *